United States Patent [19]

Simington et al.

[11] 4,286,788

[45] Sep. 1, 1981

[54] MECHANICAL ROPING STEER

[76] Inventors: Jack F. Simington, Box 141, Star Rte.; William E. Ray, Box 100, Star Rte., both of Chiloquin, Oreg. 97624

[21] Appl. No.: 88,070

[22] Filed: Oct. 24, 1979

[51] Int. Cl.[3] ..... A63B 69/00

[52] U.S. Cl. ..... 273/359; 46/123; 119/29; 273/370

[58] Field of Search ..... 273/359, 366–370; 46/123; 119/29

[56] References Cited

U.S. PATENT DOCUMENTS

| | | | |
|---|---|---|---|
| 1,353,707 | 9/1920 | Barnard | 46/123 X |
| 1,604,663 | 10/1926 | Savage | 46/123 X |
| 2,290,297 | 7/1942 | Smith | 273/370 |
| 2,398,813 | 4/1946 | Swisher | 273/369 |
| 2,793,038 | 5/1957 | Wallace et al. | 273/369 |
| 3,163,960 | 1/1965 | Iwaya et al. | 46/123 X |
| 3,324,832 | 6/1967 | McCain | 273/369 X |
| 3,363,900 | 1/1968 | Caole | 273/370 |
| 3,406,969 | 10/1968 | Tisdell et al. | 273/366 X |
| 3,776,553 | 12/1973 | Kelton | 273/367 X |
| 3,802,706 | 4/1974 | Hamm | 273/367 X |

FOREIGN PATENT DOCUMENTS

| | | | |
|---|---|---|---|
| 340600 | 7/1904 | France | 273/369 |

*Primary Examiner*—Paul E. Shapiro

*Attorney, Agent, or Firm*—Harvey B. Jacobson

[57] ABSTRACT

A pair of drive and idle pulleys are journalled from horizontally spaced apart elevated mounting structures and an elongated flexible tension member is trained about the pulleys. An elongated member extends between and is anchored relative to the mounting structures and a wheeled carriage is supported from the support member for rolling therealong. A crank is journalled from the carriage and a rotary friction drive member is journalled from the carriage and rollingly engaged with the support member for rotation relative to the carriage in response to its movement along the support member. One-way drive structure drivingly connects the drive member to the crank and an animal simulating structure is dependingly supported from the carriage and includes at least a first oscillatable body part simulating member. Connecting structure is connected between the crank and the body part simulating member for oscillation of the latter in response to rotation of the crank.

7 Claims, 8 Drawing Figures

MECHANICAL ROPING STEER

BACKGROUND OF THE INVENTION

Various forms of structures have been heretofore designed for simulating steer movement to assist in lasso or roping training. However, most of these previously known forms of structures have been deficient in one manner or another, either in proper simulation of steer movement, ease of use or manner of movement from a starting position to a remote position and back to the aforementioned starting position. Accordingly, a need exists for an improved form of steer movement simulating structure for use in lasso and roping training.

Previously known forms of lasso and roping training structures including some of the general structural and operational features of the instant invention are disclosed in U.S. Pat. Nos. 3,066,939, 3,324,823, 3,776,553, 3,947,033 and 4,081,056.

BRIEF DESCRIPTION OF THE INVENTION

The mechanical roping steer of the instant invention is constructed in a manner whereby the head and rear leg movement of a steer may be accurately simulated and the mechanical roping steer is further constructed in a manner whereby it may be ready caused to move from a starting point along a predetermined path to a distant point and thereafter back to the starting point. Still further, the mechanical roping steer is constructed in a manner whereby it is suspended from an overhead carriage and does not travel along any form of track on the ground or rely upon the ground along which it moves for support therefrom.

The main object of this invention is to provide a mechanical roping steer which will accurately simulate head and rear leg movements of a steer.

Yet another object of this invention is to provide a mechanical roping steer constructed in a manner whereby the steer simulation portion thereof may be caused to move along a predetermind path from a starting location to a distant location and then back to the starting location.

Yet another important object of this invention is to provide a mechanical roping steer in accordance with the preceding objects and constructed in a manner whereby the mechanical roping steer may be effectively utilized even over uneven ground.

Another very important object of this invention is to provide a mechanical roping steer suspended from an overhead support structure and which does not therefore rely upon direct contact from the ground over which the steer simulating portion thereof moves.

A further object of this invention to provide a mechanical roping steer constructed in a manner whereby it may be ready assembled for full operation from a knockdown condition with a minimum amount of effort and without the use of special tools.

A final object of this invention to be specifically enumerated herein is to provide a mechanical roping steer in accordance with the preceding objects and which will conform to conventional forms of manufacture, be of simple construction and easy to use so as to provide a device that will be economically feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
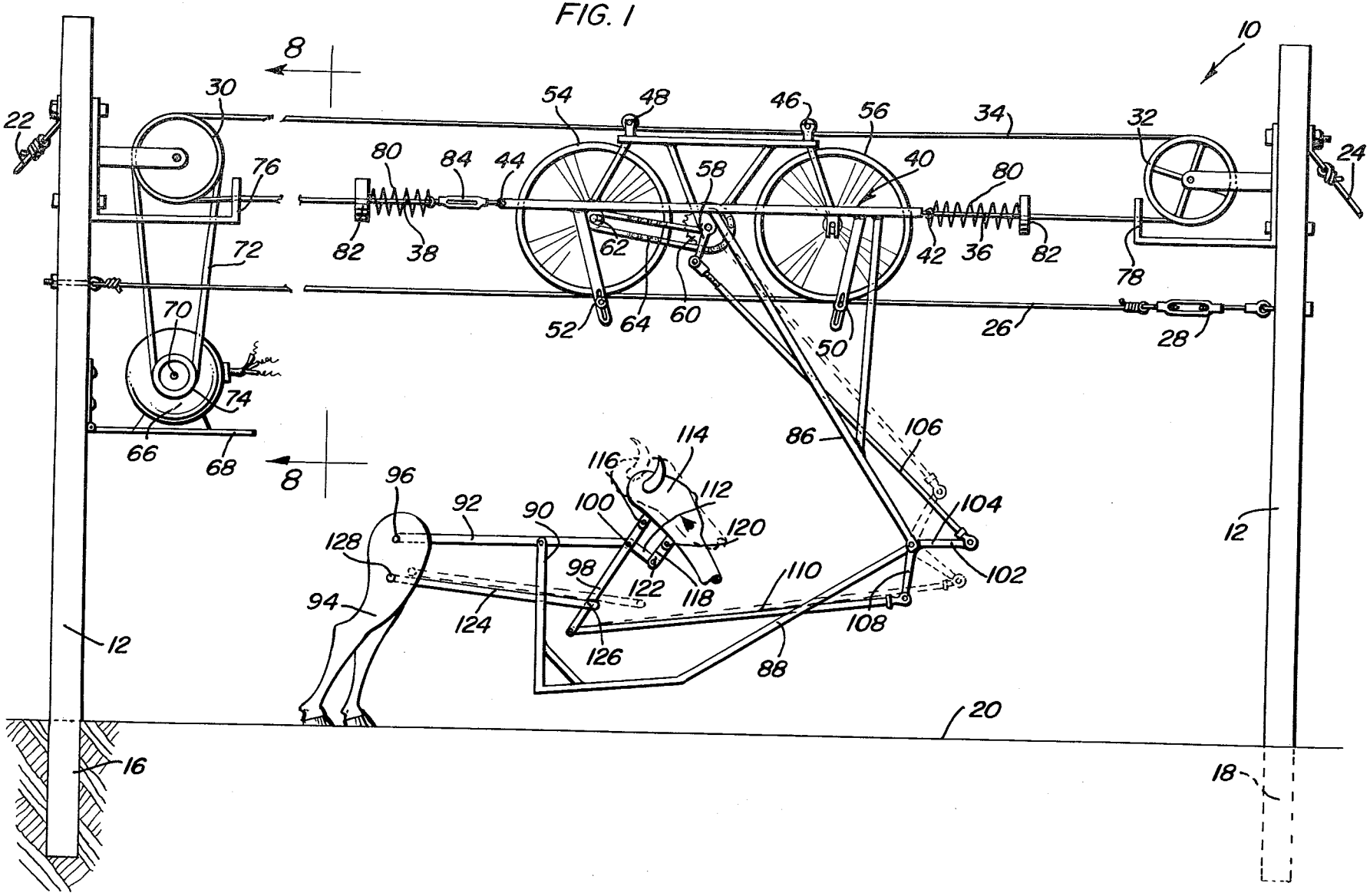
FIG. 1 is a fragmentary side elevational view of the mechanical roping steer assembly of the instant invention.
Figure 2:
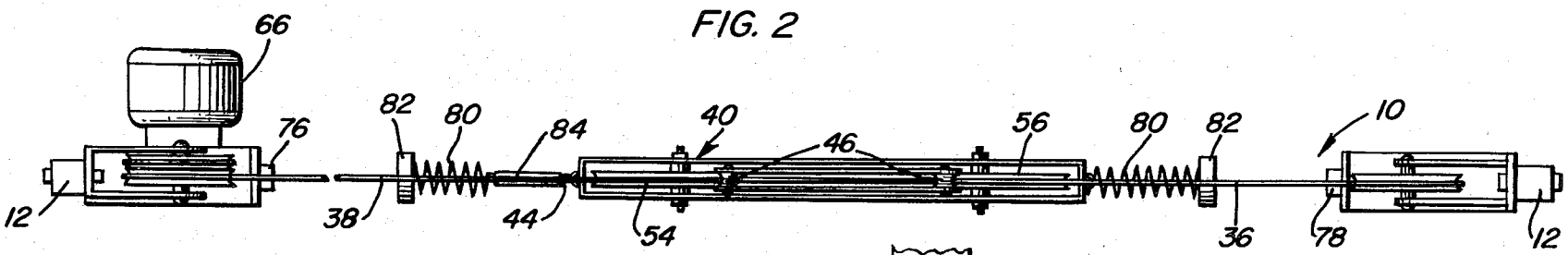
FIG. 2 is a fragmentary top plan view of the assemblage illustrated in FIG. 1.
Figure 7:
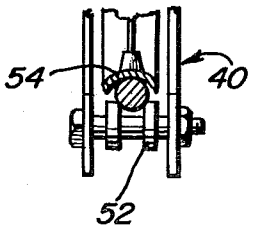
FIG. 7 is an enlarged fragmentary transverse vertical sectional view taken substantially upon the plane indicated by the sectin line 7—7 of FIG. 3.
Figure 6:
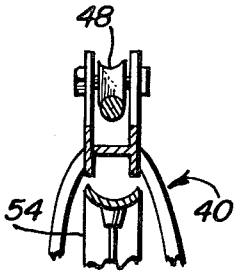
FIG. 6 is an enlarged fragmentary transverse vertical sectional view taken substantially upon the plane indicated by the section line 6—6 of FIG. 3.
Figure 8:
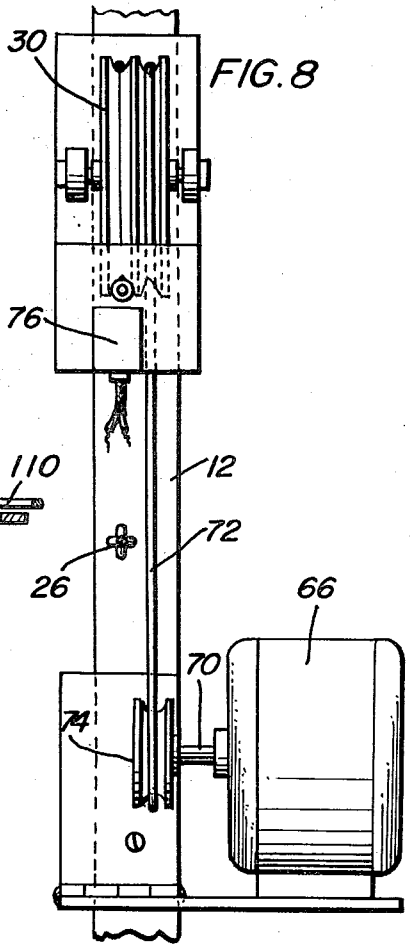
FIG. 8 is an enlarged fragmentary transverse vertical sectional view taken substantially upon the plane indicated by the section line 8—8 of FIG. 1.
Figure 5:
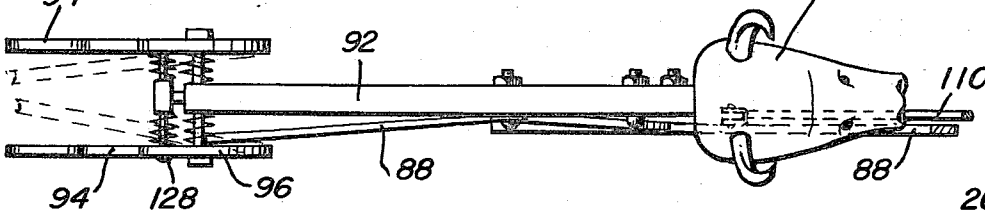
FIG. 5 is an enlarged horizontal sectional view taken substantially upon the plane indicated by the section line 5—5 of FIG. 3.
Figure 4:
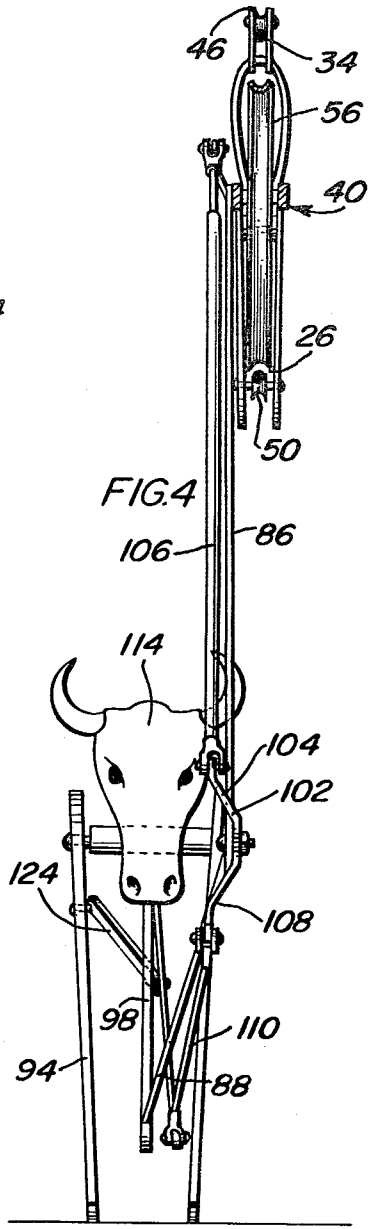
FIG. 4 is an enlarged transverse vertical sectional view taken substantially upon the plane indicated by the section line 4—4 of FIG. 3.
Figure 3:
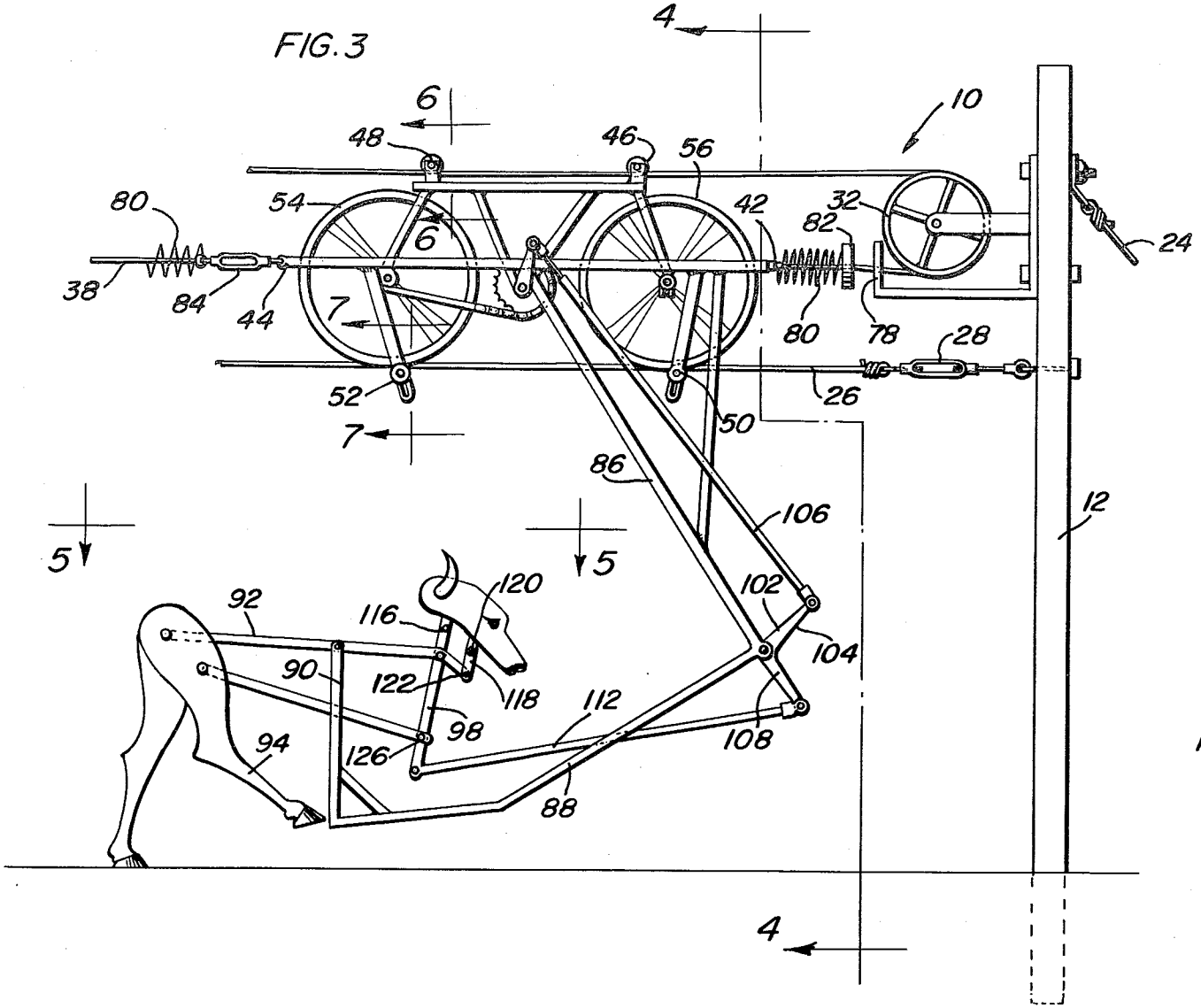
FIG. 3 is a fragmentary side elevational view of the remote location portion of the mechanical roping steer assembly to which the steer simulating portion thereof is moved from a starting position.

Referring now more specifically to the drawings, the numeral 10 generally designates the mechanical roping steer assembly of the instant invention. The assembly 10 includes a pair of horizontally spaced apart uprights 12 and 14 whose lower ends 16 and 28 are embedded in the ground 20. Also, the uprights 12 include downwardly and outwardly oppositely inclined guy wires 22 and 24 anchored between the upright 12 and the ground 20.

An elongated support member 26 extends between and has its opposite ends anchored relative to the uprights 12. The support member 26 comprises a support cable and one end of the support cable is anchored relative to the corresponding upright by adjustable means comprising a turnbuckle 28.

A pair of drive and idle pulleys 30 and 32 are journalled from the uprights 12 and an endless flexible tension member 34 is trained about the pulleys 30 and 32 and includes a pair of opposite end portions 36 and 38 anchored relative to a frame referred to in general by the reference numeral 40 as at 42 and 44. The upper portion of the frame 40 includes a pair of aligned guide pulley wheels 46 and 48 journalled therefrom and rolling guidingly engaged with the upper reach of the tension member 34 and the lower portion of the frame 40 includes a second pair of guide pulley wheels 50 and 52 rollingly engaged with the undersurface of the support member 26.

Flanged drive and idle wheels 54 and 56 are journalled from the frame 40 and are rollingly engaged with the upper side of the support member 26 for movement therealong, whereby the frame 40 is supported from the support member 26 and guided relative thereto by the pulley wheels 46 and 48 engaged with the upper reach of the tension member 34 and the guide pulleys 50 and 52 rollingly engaged with the underside of the support member 26. The frame 40 has a central crank 58 journalled therefrom and a sprocket wheel 60 is carried by the crank and a smaller sprocket wheel 62 is journalled from the drive wheel 54 and is driven by the latter in one direction of rotation of the drive wheel and free to rotate relative to the drive wheel 54 in the other direction of rotation. A chain 64 drivingly connects the sprocket wheel 62 to the sprocket wheel 60 on the crank 58.

A reversible electric motor 66 is supported from a bracket 68 mounted on the upright 12 from which the drive pulley 30 is journalled and the motor 66 includes a rotatable output shaft 70 drivingly connected to the drive pulley 30 through an endless belt 72, the electric motor output shaft 70 having a pulley 74 thereon about which the endless belt is trained and the drive pulley 30 comprising a double sheaf pulley about which the endless drive member 72 is also trained. Accordingly, the electric motor 66 is operable to drive the drive pulley 30 in opposite directions of rotation.

The uprights 12 include abutments 76 and 78 supported therefrom through which the opposite end portions 36 and 38 of the tension member 34 slidably pass, and each of the end portions 36 and 38 has a compression spring 80 disposed thereabout anchored to the tension member at adjacent ends. The springs 80 including abutment members 82 at their remote ends engageable with the abutment members 76 and 78, and the tension member end portion 38 is anchored to the frame 40 as at 44 through a turnbuckle 84 whereby the tension of the tension member 34 may be adjusted sufficiently to enable the frictional contact between the drive pulley 30 and the tension member 34 to cause movement of the frame 40 along the support member 46, but the tension member 34 is sufficiently slack to allow slippage of the drive pulley 30 relative to the tension member 34 when either of the abutments 82 engage the abutments 76 or 78.

The frame 40 includes a depending portion 86 terminating at its lower end in a rearwardly and downwardly inclined arm portion 88. The rearwardly and downwardly inclined arm portion 88 terminates downwardly in an upwardly directed portion 90 supporting an upper horizontal member 92 therefrom extending along a path extending between the uprights 12. A pair of depending rear legs 94 are pivotally supported from the rear end of the horizontal member 92 as at 96 and an upstanding lever 98 has its midportion oscillatably supported as at 100 from the forward end portion of the horizontal member 92.

A bell crank 102 is oscillatably supported from the lower end of the depending portion 86 and one arm 104 of the bell crank 102 is connected to the crank 58 by an elongated adjustable length connecting member 106. The other arm 108 of the bell crank 102 is connected to the lower end of the lever 98 by an elongated adjustable length connecting member 110.

The forward end of the horizontal member 92 terminates in a forwardly and downwardly inclined forward end portion 112 and a steer simulating head 114 has an upper rear portion thereof pivotally connected to the upper end of the lever 98 as at 116 and a forward underside portion thereof pivotally connected to the upper end of a connecting link 118 as at 120, the lower end of the connecting link 118 being pivotally connected to the forwardly and downwardly inclined terminal end 112 as at 122. The link 118 substantially parallels the upper end of the lever 98 and, thus, the steer simulating head 114 is supported by a parallelogram linkage from the horizontal member 92, the oscillatable lever 98 comprising a portion of the parallelogram linkage.

A lower portion of the lever 98 is operably connected to a lower portion of one of the legs 94 by a connecting lever 124 pivotally connected to the lever 98 as at 126 and to the one leg 94 as at 128.

Assuming that the frame 40 is disposed to the left as viewed in FIG. 1, the motor 66 is actuated in a forward direction whereby the drive pulley 30 is rotated in a counterclockwise direction thereby causing the frame 40 to move along the support member 26 from the left side of FIG. 1 to the right side thereof. During movement of the frame 40 to the right and rotation of the drive wheel 54 in a clockwise direction, the sprocket wheel 62 drives the sprocket wheel 60 and thus the crank 58 through the chain 64. Thus, the head 114 and one leg 94 are oscillated back and forth. As the frame 40 approaches the left hand upright 12, the spring mounted abutment member 82 on the right side of the frame 40 engages the right hand abutment 78 to stop movement of the frame 40 to the right, the tension member 34 being sufficiently slack to enable the drive pulley 30 to slip relative to the tension member 34 when movement of the frame 40 to the right is terminated. Then, the motor 66 may be turned off and subsequently operated in the opposite direction in order to return the frame 40 from the right-hand position to the left-hand position thereof as illustrated in FIG. 1. Inasmuch as the drive wheel 54 enjoys only a one-way connection with the sprocket wheel 62, during movement of the frame 40 from the right of FIG. 1 to the left of FIG. 1, the drive wheel 54 is inoperative to drive the sprocket 62 and to thus cause oscillation of the head 114 and the leg 94 to which the connecting member 124 is connected.

It will be noted that the support of the head 114 from the horizontal member 92 through the use of a parallelogram linkage causes the head 114 to be oscillated back and forth in a forwardly and downwardly and rearwardly and upwardly inclined plane. Furthermore, oscillation of the one leg 94 to which the connecting member 124 is connected is in time sequence with oscillation of the head 114.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A mechanical roping steer assembly including a pair of elevated horizontally spaced apart mounting structures, a pair of drive and idle pulleys journalled from said mounting structures, an elongated flexible tension member trained about said pulleys and arranged in two generally parallel reaches, an elongated support member extending between and anchored relative to said mounting structures, a wheeled carriage supported from said support member for rolling therealong, a crank journalled from said carriage, drive means drivingly connecting a wheel of said carriage to said crank, said carriage including a depending support structure projecting downwardly below said reaches, said support member and said carriage and including a lower portion, an arm portion projecting horizontally outwardly from said lower portion of said support structure in one direction along said support member and including a free end portion, an animal simulating structure supported from said free end portion and including at least a first oscillatable head simulating body part, connecting structure connecting said crank to said body part for oscillation of the latter in response to rotation of the crank, said head simulating body part disposed at an elevation above said free end of said arm and spaced below said reaches, said support member and said carriage, said animal simulating structure defining front and rear ends spaced along said support member with said head simulating body part defining said front end, said front end facing toward and spaced horizontally rearwardly from said lower portion of said depending support structure, reversible rotary drive motor means drivingly connected to said drive pulley, one of said reaches of said flexible tension member being anchored relative to said frame.

2. The combination of claim 1 wherein said animal simulating structure includes a second oscillatable body part simulating member, said connecting structure also connecting said crank to said second oscillatable body part simulating member for oscillation thereof in timed relation relative to oscillation of the first body part simulating member in response to rotation of said crank.

3. The combination of claim 2 wherein said body part simulating members simulate head and leg portions of a bovine animal.

4. The combination of claim 1 wherein said spaced apart mounting structures comprise uprights including power end portions for support from the ground, said dependingly supported animal simulating structure being supported beneath said carriage in vertically spaced relation thereto for positioning immediately above the ground from which the lower ends of said uprights are supported.

5. The combination of claim 4 wherein said uprights include abutment members at least closely associated with the opposite end portions of at least said one reach of said tension member, said carriage including opposite end abutment portions engageable with said abutment members for limiting movement of said carriage between said uprights.

6. The combination of claim 5 wherein said abutment portions are spring supported from said carriage for cushioning impact of said abutment portions with said abutment members.

7. The combination of claim 1 wherein said carriage includes upper guide means, said reaches of said tension member being vertically spaced, said upper guide means guidingly engaging the upper reach of said tension member, the lower reach of said tension member comprising said one reach thereof.

* * * * *